US006761468B1

(12) United States Patent
Bogal

(10) Patent No.: US 6,761,468 B1
(45) Date of Patent: Jul. 13, 2004

(54) LIGHT EMITTING APPARATUS WITH LIGHT DIFFUSING ATTACHMENT

(76) Inventor: Perry Charles Bogal, 12 David Dr., Syosset, NY (US) 11791

( * ) Notice: Subject to any disclaimer, the term of this patent is extended or adjusted under 35 U.S.C. 154(b) by 0 days.

(21) Appl. No.: 10/161,870

(22) Filed: Jun. 4, 2002

(51) Int. Cl.[7] ..... F21L 4/00
(52) U.S. Cl. ..... 362/208; 362/205; 362/200
(58) Field of Search ..... 362/205, 200, 362/201, 332, 558, 253, 109, 116, 806, 812, 559, 208, 811, 330; 40/547, 555, 330, 634

(56) References Cited

U.S. PATENT DOCUMENTS 4,858,083 A * 8/1989 Wakimoto ..... 362/208
5,931,562 A * 8/1999 Arato ..... 362/205

* cited by examiner

*Primary Examiner*—Sandra O'Shea
*Assistant Examiner*—Bao Q. Truong
(74) *Attorney, Agent, or Firm*—Parsons & Goltry; Michael W. Goltry; Robert A. Parsons

(57) ABSTRACT

Disclosed is a device capable of generating and emitting light and a translucent light diffusing element attached to the device to receive and diffuse light from the device. The device is composed of a housing that supports a switch and a light source capable of emitting multi-colored light. The light source is capable of being disposed in an illuminated state in response to actuation of the switch. Indicia are carried by the light diffusing element, which illuminates when the light source is disposed in its illuminated state. The light diffusing element consists of a translucent body having a proximal end attached to the device, an opposing distal end, and a receptacle disposed between the proximal and distal ends. The translucent member is removably disposed in the receptacle, and the indicia are carried by the translucent member.

19 Claims, 4 Drawing Sheets

10
30
31
INDICIA
11
41
16
40
42
20
15
17
56
55
INDICIA
51
50A
12
50
50B 60
50A
51
61'
50B
67
50
56
65
INDICIA
63
61
64
66
62
62'
80
50A
51
81'
55
81
67
61'

INDICIA
82
50
50B
56

LIGHT EMITTING APPARATUS WITH LIGHT DIFFUSING ATTACHMENT

FIELD OF THE INVENTION

This invention relates to lighting and to hand-held light emitting devices.

BACKGROUND OF THE INVENTION

Lighting is a field of art that enjoys considerable innovation and attention. From domestic lighting and lighting installations, to photographic equipment and flashlights and other portable lighting devices, improvements in the art are marked not only by improved energy efficient lighting and lighting systems but also to improved light bulbs and light emitting diodes that are capable of exhibiting enhanced lighting effects. Although the art is replete with a vast array of exemplary lighting apparatus, the continued need for certain new and useful improvements remains.

SUMMARY OF THE INVENTION

The objects and advantages of the invention are realized in new and improved light emitting apparatus with improved light diffusing attachments. An exemplary apparatus embodiment of the invention consists of a device capable of generating and emitting light, a light diffusing element attached to and extending away from the device for receiving and diffusing light from the device, and indicia carried by the light diffusing element. The device consists of a housing that supports a switch and a multi-colored light source. Preferably, the multi-colored light source is a red/blue/green light emitting diode. The switch is movable between a first condition ("ON") activating the device placing the light source in an active or illuminated state, and a second condition ("OFF") deactivating the device placing the light source in a resting or non-illuminated state. Preferably, the light source is capable of being disposed in a plurality of different illuminated states in response to actuation of the switch. In another embodiment, the device incorporates a plurality of switches, in which the light source is capable of being disposed in a plurality of different illuminated states in response to actuation of the switches. Preferably, a finger-holding appendage is attached to and extends away from the device and a translucent member attached to the light diffusing element carries the indicia. The light diffusing element consists of a translucent body having a proximal end attached to the device, an opposing distal end, and a receptacle disposed between the proximal and distal ends. A translucent member is removably disposed in the receptacle, and the translucent member carries the indicia. The receptacle is composed of a socket extending into the translucent body, in which the translucent member removably is disposed in the socket. In one embodiment, the receptacle consists of a tubular socket and the translucent member consists of a tubular sleeve disposed in the tubular socket. The sleeve is flexible and severed defining opposing free ends and an end gap therebetween. In another embodiment, the receptacle is a plate socket, and the translucent member consists of a translucent plate disposed in the plate socket.

Another apparatus embodiment of the invention includes a device capable of generating and emitting light, and a translucent body having a proximal end attached to the device, an opposing distal end, and a receptacle disposed between the proximal and distal ends. The translucent body is to receive and diffuse light from the device. A translucent member is removably disposed in the receptacle, and the translucent member carries indicia. The receptacle is composed of a socket extending into the translucent body, in which the translucent member removably is disposed in the socket. In one embodiment, the receptacle consists of a tubular socket and the translucent member consists of a tubular sleeve disposed in the tubular socket. The sleeve is flexible and severed defining opposing free ends and an end gap therebetween. In another embodiment, the receptacle is a plate socket, and the translucent member consists of a translucent plate disposed in the plate socket. The device consists of a housing that supports a switch and a multi-colored light source. Preferably, the multi-colored light source is a red/blue/green light emitting diode. The switch is movable between a first condition ("ON") activating the device placing the light source in an active or illuminated state, and a second condition ("OFF") deactivating the device placing the light source in a resting or non-illuminated state. Preferably, the light source is capable of being disposed in a plurality of different illuminated states in response to actuation of the switch. In another embodiment, the device incorporates a plurality of switches, in which the light source is capable of being disposed in a plurality of different illuminated states in response to actuation of the switches. Preferably, a finger-holding appendage is attached to and extends away from the device.

Consistent with the foregoing, the invention also contemplates associated methods.

BRIEF DESCRIPTION OF THE DRAWINGS

Referring to the drawings.

DETAILED DESCRIPTION OF A PREFERRED EMBODIMENT

Figure 1:
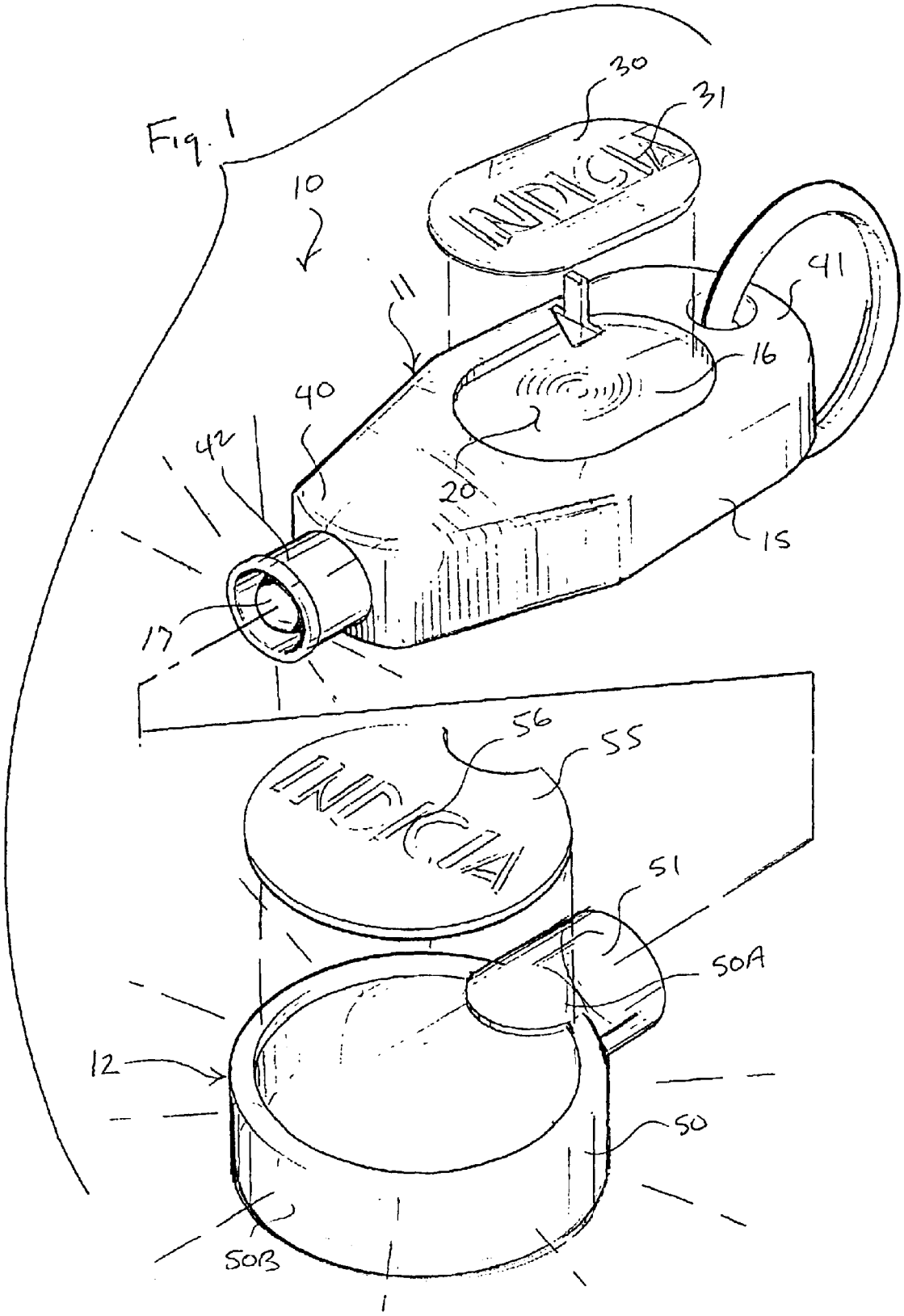
FIG. 1 is an exploded perspective view of light emitting apparatus constructed in accordance with the principle of the invention, the light emitting apparatus consisting a device capable of generating and emitting light, a light diffusing element attached to and extending away from the device for receiving and diffusing light from the device, and indicia carried by the light diffusing element.
Figure 4:
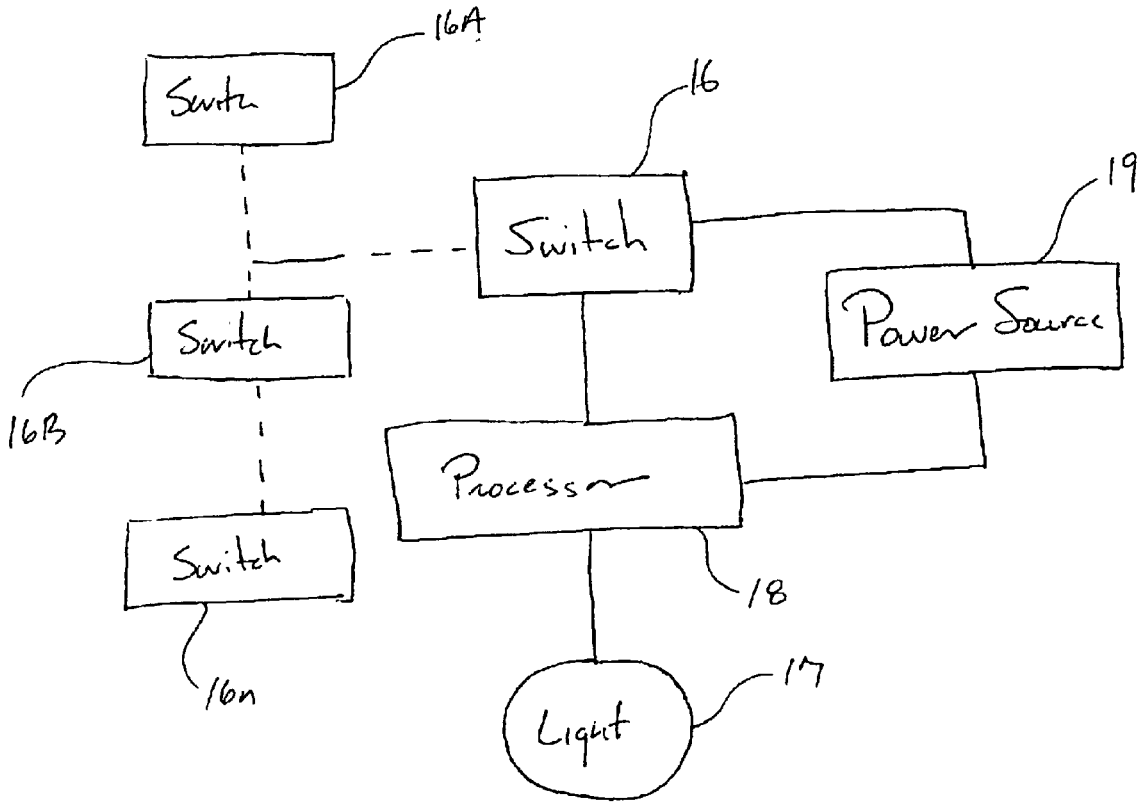
FIG. 4 is a schematic diagram of components of the device of FIG. 1.

Turning now to the drawings, in which like reference characters indicate corresponding elements throughout the several views, attention is directed to FIG. 1, in which is seen light emitting apparatus, embodying the principle of the invention, generally indicated by the reference character 10 including a device 11 capable of generating and emitting light and a light diffusing element 12. Device 11 consists of a housing 15 that supports and contains a switch 16, and, as denoted in FIG. 4, a light source 17, a processor 18 and a power source 19. Switch 16, light source 17, processor 18 and power source 19 are coupled together in electrical communication with conventional circuitry, and preferably with the use of a circuit board disposed in housing 15 as a matter of convenience. Light source is a light emitting diode (LED) and, in accordance with a preferred embodiment, a multi-colored LED, namely, a red/green/blue LED (commonly referred to as a "RGB LED") that, when energized and is illuminated, produces either a band of continuously changing colored light or strobe-like flashes of colored light. In the immediate embodiment, power source 18 is conventional lithium battery and switch 16 is a conventional toggle switch. Other suitable battery and switch forms can be employed. By acting on switch 16 with a forcible impulse, such as with a finger, switch 16 is capable of being deployed or otherwise moved between a first or "ON" condition activating device 11 (closing the circuit) energizing light source 17 placing it in an active or illuminated state, and a second or "OFF" condition deactivating device 11 (opening the circuit) de-energizing light source 17 placing it in a resting, dormant or non-illuminated state. As seen in FIG. 1, switch 16 is disposed at an opening 20 of housing 15 and is available to be acted upon with a forcible impulse, such as with a finger.

Preferably, light source 17 is capable of being disposed in a plurality of different illuminated states in response to actuation of switch 16, in accordance with the principle of the invention, and processor 18 is provided for this aspect of the invention. Preferably, the different illuminated states consist of 1) a band of continuously changing colored light and 2) strobe-like flashes of colored light. More or other different illuminated states can be used, if desired, whether with colored light or a variety of differently colored light. In this respect, processor 18, which is conventional in nature and can be considered part of switch 16, is responsive to repeated activation of switch 16 causing light source 17 to be disposed between its resting or dormant state, a first illuminated state consisting of one consist of the band of continuously changing colored light and the strobe-like flashes of colored light, and the second illuminated state consisting of the other of the band of continuously changing colored light and the strobe-like flashes of colored light. In this respect, processor 18 is responsive to repeated actuation of switch 16 placing it in different modes of operation resulting in the disposition of light source 17 between its different operational states as described. Rather than toggling between these different states with a single switch, device 11 can incorporate a plurality of switches 16A, 16B, 16*n*, if desired, each corresponding to one of the resting state of light source 17, the illuminated state of light source 17 consisting of the band of continuously changing colored light, and the illuminated state of light source 17 consisting of the strobe-like flashes of colored light. Any suitable number of switches can be employed, in accordance with the invention.

Referring to FIG. 1, housing 15 is formed of plastic, polyurethane or other similar material or combination of materials, and is integrally formed, but it can be formed as an assembly of two or more attached parts, if desired. At opening 20 is a support member 30 bearing indicia 31. Support member 30 is attached with adhesive, lamination, etc., and indicia 31 are imparted to support member 30 by way of printing, etching, adhesive attachment, lamination, etc. Indicia 31 are advertising or sensible indicia such as logo type indicia, logo wording, etc., for the purpose of conveying an advertising or other message or impression. Support member 30 is preferably constructed of plastic, polyurethane or other similar material or combination of materials, and is preferably translucent, although it can be opaque, if desired. For the purpose orientation, housing 15 defines forward and rearward ends 40, 41. Extending from forward end is light source 17, which is surrounded by an attached sleeve 42 of housing 15.

Light diffusing element 12 consists of a light diffusing body 50. Preferably, body 50 is translucent and fashioned of translucent plastic, polyurethane, glass, or other suitable translucent material, whether colored. In the immediate embodiment, body 50 is generally round or disk-shaped. Other shapes can be used, whether an abstract shape, the shape of a square, the shape of a rectangle, the shape of a diamond, or other desired shape such as that of a baseball bat, a baseball hat, a football, a baseball, the head of a selected athlete, a baseball, a soccer ball, a motorcycle helmet, a bicycle helmet, a trademark logo, etc. Other shapes can be used. Preferably, body 15 is integrally fashioned such as with molding, but it can be formed as an assembly of two or more attached parts.

For the purpose of orientation, body 50 includes proximal and distal ends 50A, 50B. Extending from distal end 50A is a tubular projection 51, which is adapted to fit over and secure sleeve 42 securing light diffusing element 12 to device 11, in which light generated by light source 17 causes the illumination of light diffusing element 12 providing a desired pleasing illuminated effect therof. The arrangement of sleeve 42 and tubular projection 51 constitutes an embodiment of a male/female engagement pair, and their described positioning can be reversed if desired. Other male/female engagement forms can be used. It is desirable that the attachment between light diffusing element 12 and device be removable, permitting the ability to utilize device 11 with a plurality of different light diffusing elements. In the embodiment depicted in FIG. 1, body 50 incorporates a translucent member 55 bearing indicia 56. Translucent member 55, which is considered part of body 50 and constructed of the same material as body 50, is integral with body 50, but it can be a separate element attached with adhesive, lamination, etc. Indicia 56 are imparted to support member 30 by way of printing, etching, embedding, adhesive attachment, lamination, etc. Indicia 31 are advertising or sensible indicia such as logo type indicia, logo wording, etc., for the purpose of conveying an advertising or other message or impression. Light generated by light source 17 causes the illumination of indicia 56, highlighting it or otherwise causing indicia 56 to impart a desired illuminated effect, enhancing it making it visually pronounced and readily visually perceivable or visually attractive. Indicia 56 can be constructed and arranged to exhibit any desired illuminated effect.

Figures 2, 3:
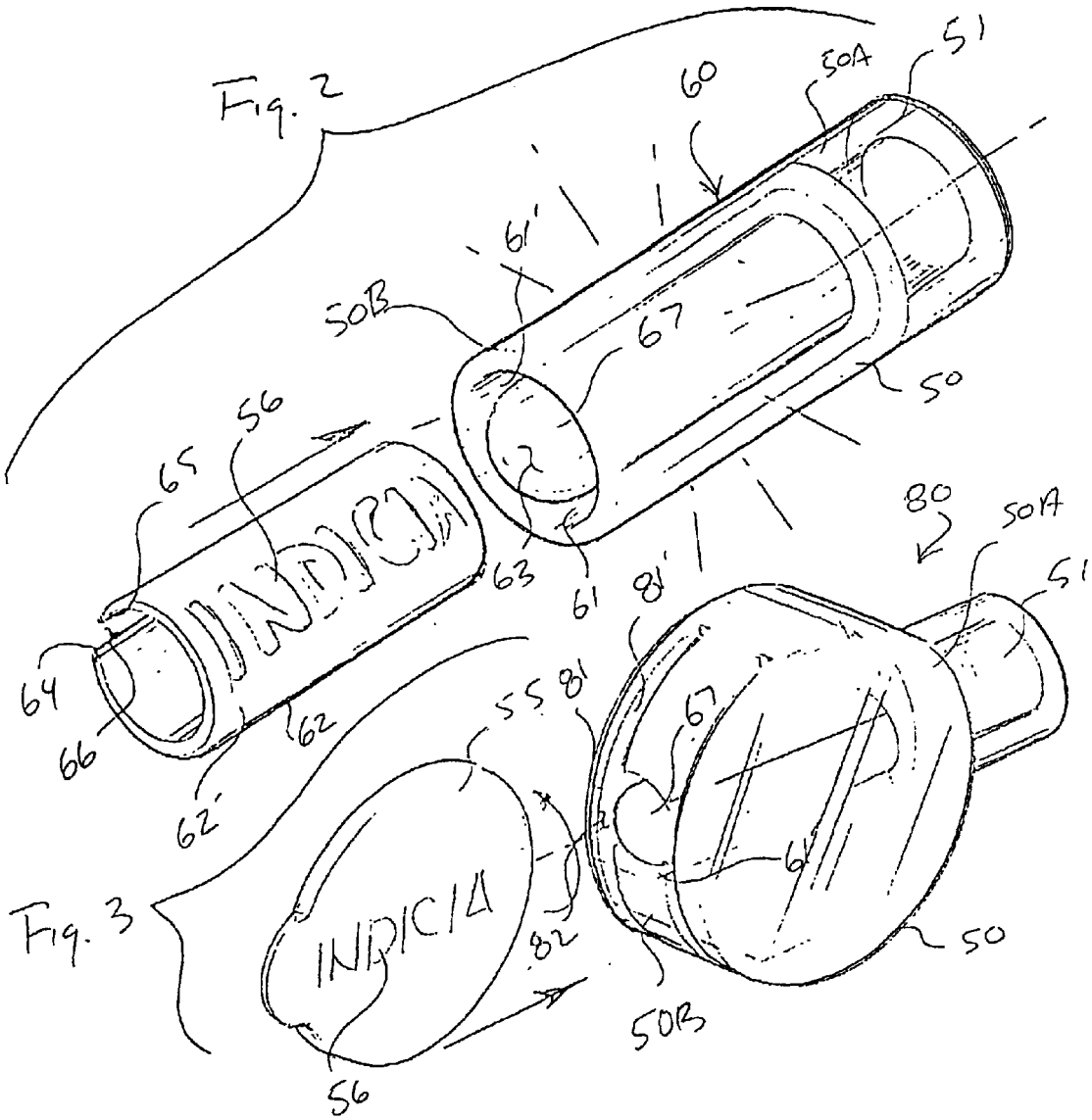
FIG. 2 is an exploded perspective view of another embodiment of a light diffusing element and a detachably engagable translucent member bearing indicia, the light diffusing element capable of being employed with the device of FIG. 1.
FIG. 3 is an exploded perspective view of yet another embodiment of a light diffusing element and a detachably engagable translucent member bearing indicia, the light diffusing element capable of being employed with the device of FIG. 1.

FIGS. 2 and 3 illustrate other embodiments of light diffusing elements capable of being used with device 11 like light diffusing element 12. Referring to FIG. 2, a light diffusing element 60 is depicted. Like light diffusing element 12, light diffusing element 60 shares body 50, proximal end 50A, distal end 50B and tubular projection 51, which is adapted to fit over and secure sleeve 42 securing light diffusing element 60 to device 11, in which light generated by light source 17 causes the illumination of light diffusing element 60 providing a desired pleasing illuminated effect therof. The arrangement of sleeve 42 and tubular projection 51 of light diffusing element 60 constitutes an embodiment of a male/female engagement pair, and their described positioning can be reversed if desired. Other male/female engagement forms can be used in connection with light diffusing element 60 and device 11.

In the embodiment depicted in FIG. 2, and unlike light diffusing element 12, body 50 is generally cylindrical and defines a receptacle 61, which is disposed between proximal and distal ends 50A, 50B. A translucent member 62 is capable of being removably disposed in receptacle 61. In this embodiment, receptacle 61 is composed of a tubular socket 61' extending into body 50 from an opening 63 at distal extremity 50B, and translucent member 62 is a tubular sleeve 62' capable of being disposed in tubular socket 61'. Tubular sleeve 62' is flexible and severed defining opposing free ends 64, 65 and an end gap 66 therebetween. Preferably, body 50 of light diffusing element 60 is fashioned with an attached elongate guide 67 disposed in tubular socket 61', over which tubular sleeve 62' is to be disposed. In this embodiment, guide 67 is attached at proximal end 50A and extends through tubular socket 61' toward distal end 50B. Tubular sleeve 62' can be constructed to be outwardly expansive to frictionally exert against and engage the interior surfaces of tubular socket 61', or inwardly constrictive so as to frictionally exert against and engage the exterior surfaces of guide 67.

Tubular sleeve 62' is constructed of the same material translucent member 55 of light diffusing element 12. In common to translucent member 55, indicia 56 are imparted to tubular sleeve 62' by way of printing, etching, embedding, adhesive attachment, lamination, etc. With tubular sleeve 62' disposed in tubular socket 61', and with light diffusing element 60 attached to device 11, light generated by light source 17 causes the illumination of light diffusing element 60 and indicia 56 as previously described in connection with light diffusing element 12. Tubular sleeve 62' is easily installed into tubular socket 61' and easily removed therefrom for replacement, repair, etc.

Referring to FIG. 3, a light diffusing element 80 is depicted. Like light diffusing element 12, light diffusing element 80 shares body 50, proximal end 50A, distal end 50B, tubular projection 51 and translucent member 55 including its attached indicia 56. Unlike light diffusing element 12, body 50 defines a receptacle 81, which is disposed between proximal and distal ends 50A, 50B. Translucent member 55 is capable of being removably disposed in receptacle 81. In the immediate embodiment, receptacle 81 is composed of a plate socket 81' extending into body 50 from an opening 82 at distal extremity 50B. Translucent member 55 is a plate or otherwise generally round and flat, and is capable of being disposed in plate socket 81' by way of opening 82. Translucent member 55 is easily installed into plate socket 81' and easily removed therefrom for replacement, repair, etc. Light diffusing element 80 in FIG. 3 incorporates tubular socket 61' including guide 67 as a desirable option for facilitating the attachment of tubular sleeve 62' (FIG. 2).

Figure 6:
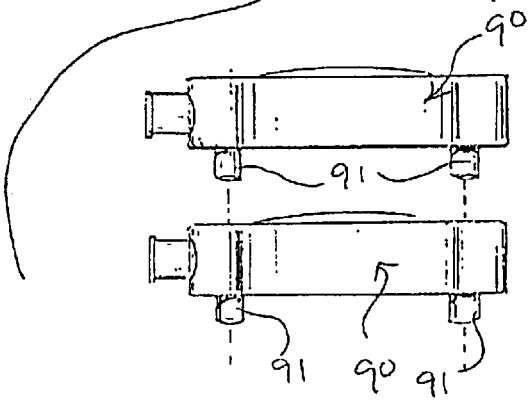
FIG. 6 is a side elevation of the devices of FIG. 5.
Figure 5:
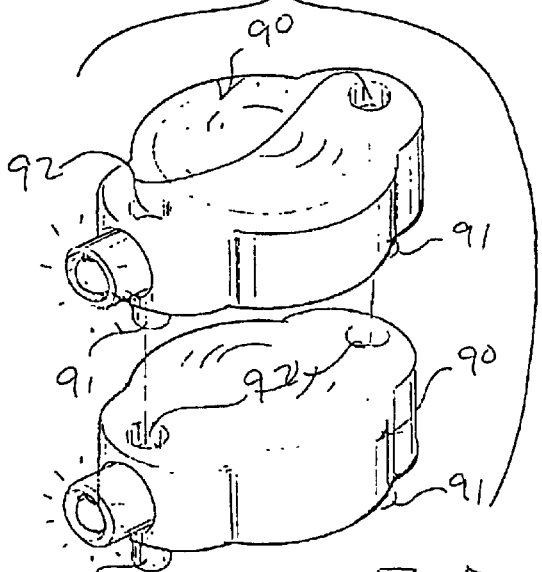
FIG. 5 is a perspective view devices capable of emitting light and incorporating engagement apparatus facilitating their mutual engagement, in accordance with the principle of the invention.
Figure 8:
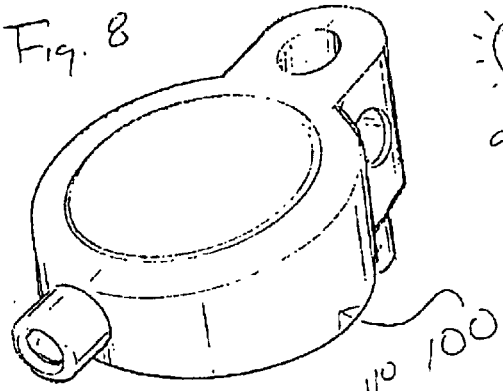
FIG. 8 is a perspective view of one of the devices of FIG. 7.

FIG. 5 illustrates a pair of devices 90 each capable of generating and emitting light and securing light diffusing elements, like the embodiment designated 10 previously discussed. Devices 90 incorporate male and female engagement features 91, 92 permitting their mutual engagement, one atop the other. Any number of devices 90 can be attached together in the manner immediately described, whether two or more. FIG. 6 is illustrative of a side elevation of devices 90 of FIG. 1. Devices 90 are each constructed and arranged to operate in a manner like that of device 11 previously described.

Figure 7:
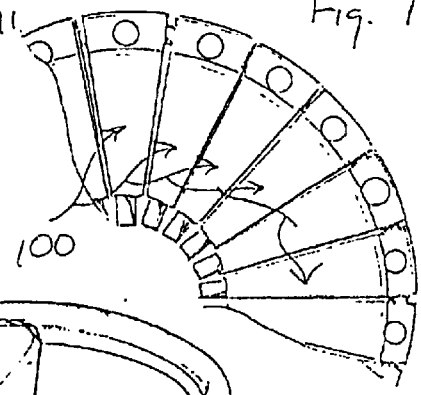
FIG. 7 is a side elevation of attached devices each capable of emitting light, in accordance with the principle of the invention.

FIG. 7 illustrates devices 100 each capable of generating and emitting light and securing light diffusing elements, like the embodiment designated 10 previously discussed. Like devices 90, devices 100 incorporate male and female engagement features permitting their mutual side-by-side engagement as illustrated, forming a curved shape of attached devices 100. Any number of devices 100 can be attached together in the manner described, whether two or more. FIG. 6 is illustrative of a perspective view of one of devices 100. Devices 100 are each constructed and arranged to operate in a manner like that of device 11 previously described.

Figure 9:
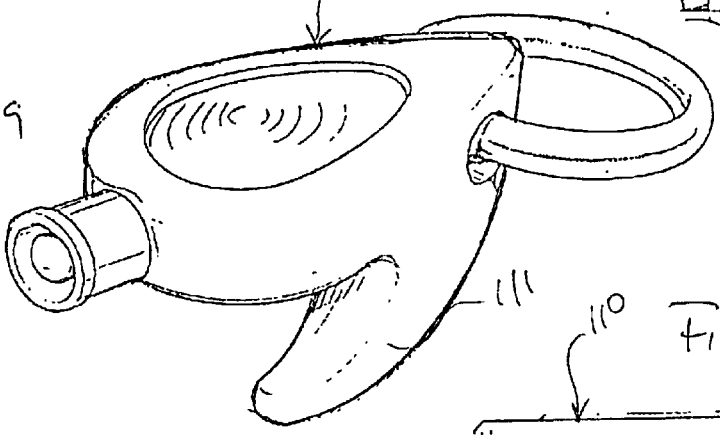
FIG. 9 is yet another embodiment of a device capable of emitting light in accordance with the principle of the invention.
Figure 10:
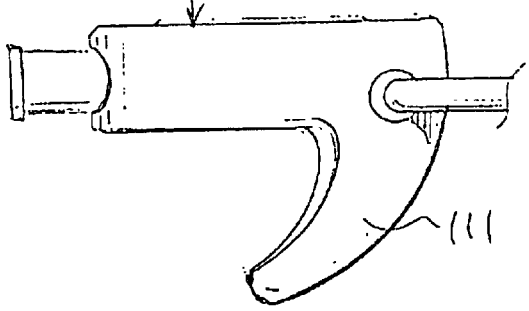
FIG. 10 is a side elevation of the device of FIG. 9.

FIG. 9 illustrates a device 110 capable of generating and emitting light and securing a light diffusing element, like the embodiment designated 10 previously discussed. Device 110 incorporates an attached finger-holding appendage 111, which is attached to and extends away from the device 110 at its proximal end. In taking up device 110 by hand, a finger is capable of being wrapped around appendage 111 facilitating a desirably firm and secure hold of device 110. FIG. 10 is illustrative of a side elevation of device 110. Other than appendage 111, device 110 is constructed and arranged to operate in a manner like that of device 11 previously described.

The present invention is described above with reference to preferred embodiments. However, those skilled in the art will recognize that changes and modifications may be made in the described embodiments without departing from the nature and scope of the present invention. Various changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. Apparatus comprising:

a device capable of generating and emitting light;

a light diffusing element attached to and extending away from the device for receiving and diffusing light from the device; and indicia carried by the light diffusing element;

wherein the light diffusing element comprises:

a translucent body having a proximal end attached to the device, an opposing distal end, and a receptacle disposed between the proximal and distal ends;

a translucent member removably disposed in the receptacle; and the indicia carried by the translucent member.

2. Apparatus of claim 1, the device comprising:

a housing that supports a switch and a multi-colored light source;

the light source capable of being disposed in an illuminated state in response to actuation of the switch.

3. Apparatus of claim 1, the device comprising:

a housing that supports a switch and a multi-colored light source;

the light source capable of being disposed in a plurality of different illuminated states in response to actuation of the switch.

4. Apparatus of claim 1, the device comprising;

a housing that supports switches and a multi-colored light source;

the light source capable of being disposed in a plurality of different illuminated states in response to actuation of the switches.

5. Apparatus of claim 1, further comprising a finger-holding appendage attached to and extending away from the device.

6. Apparatus of claim 1, wherein the indicia are carried by a translucent member attached to the light diffusing element.

7. Apparatus of claim 1, wherein:

the receptacle comprises a socket extending into the translucent body; and the translucent member removably disposed in the socket.

8. Apparatus of claim 1, wherein:

the receptacle comprises a tubular socket; and the translucent member comprises a tubular sleeve disposed in the tubular socket.

9. Apparatus of claim 8, wherein the sleeve is flexible and severed defining opposing free ends and an end gap therebetween.

10. Apparatus of claim 1, wherein:

the receptacle comprises a plate socket; and the translucent member comprises a translucent plate disposed in the plate socket.

11. Apparatus comprising:

a device capable of generating and emitting light;

a translucent body having a proximal end attached to the device, an opposing distal end, and a receptacle disposed between the proximal and distal ends:

the translucent body for receiving and diffusing fight from the device;

a translucent member removably disposed in the receptacle; and indicia carried by the translucent member.

12. Apparatus of claim 11 wherein:

the receptacle comprises a socket extending into the translucent body; and the translucent member removably disposed in the socket.

13. Apparatus of claim 12, wherein:

the receptacle comprises a tubular socket; and the translucent member comprises a tubular sleeve disposed in the tubular socket.

14. Apparatus of claim 13, wherein the sleeve is flexible and severed defining opposing free ends and an end gap therebetween.

15. Apparatus of claim 11, wherein:

the receptacle comprises a plate socket; and the translucent member comprises a translucent plate disposed in the plate socket.

16. Apparatus of claim 11, the device comprising:

a housing that supports a switch and a multi-colored light source;

the light source capable of being disposed in an illuminated state in response to actuation of the switch.

17. Apparatus of claim 11, the device comprising:

a housing that supports a switch and a multi-colored light source;

the light source capable of being disposed in a plurality of different illuminated states in response to actuation of the switch.

18. Apparatus of claim 11, the device a housing that supports switches and a multi-colored light source;

the light source capable of being disposed in a plurality of different illuminated states in response to actuation of the switches.

19. Apparatus of claim 11, further comprising a finger-holding appendage attached to and extending away from the device.

* * * * *

UNITED STATES PATENT AND TRADEMARK OFFICE

CERTIFICATE OF CORRECTION

PATENT NO. : 6,761,468 B1
DATED : July 13, 2004
INVENTOR(S) : Bogal, Perry Charles It is certified that error appears in the above-identified patent and that said Letters Patent is hereby corrected as shown below:

Column 8,
Line 28, reads "Apparatus of Claim 11, the device a housing" should read -- Apparatus of Claim 11, the device comprising a housing --.

Signed and Sealed this

Twenty-second Day of February, 2005

JON W. DUDAS
*Director of the United States Patent and Trademark Office*